US009833994B2

(12) United States Patent
Nishimura et al.

(10) Patent No.: US 9,833,994 B2
(45) **Date of Patent: *Dec. 5, 2017**

(54) INKJET HEAD THAT CIRCULATES INK

(71) Applicants: Hiroshi Nishimura, West Hills, CA (US); Giang Vo, Simi Valley, CA (US); Connor Matsumori, Camarillo, CA (US)

(72) Inventors: Hiroshi Nishimura, West Hills, CA (US); Giang Vo, Simi Valley, CA (US); Connor Matsumori, Camarillo, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/458,765

(22) Filed: Mar. 14, 2017

(65) Prior Publication Data

US 2017/0182777 A1 Jun. 29, 2017

Related U.S. Application Data

(63) Continuation of application No. 15/007,105, filed on Jan. 26, 2016, now Pat. No. 9,630,408, which is a (Continued)

(51) Int. Cl.
*B41J 2/14* (2006.01)

(52) U.S. Cl.
CPC ..... *B41J 2/14274* (2013.01); *B41J 2/1433* (2013.01); *B41J 2/14233* (2013.01); *B41J 2002/14419* (2013.01); *B41J 2202/12* (2013.01)

(58) Field of Classification Search
CPC ..... B41J 2/1433; B41J 2/14201; B41J 2/18; B41J 2/14274; B41J 2002/14419; B41J 2202/12
See application file for complete search history.

(56) References Cited

U.S. PATENT DOCUMENTS 5,087,930 A 2/1992 Roy et al.
5,489,930 A 2/1996 Anderson
(Continued)

FOREIGN PATENT DOCUMENTS

JP 2007069127 A 3/2007
JP 2008290292 A 12/2008
JP 2012011629 A 1/2012

OTHER PUBLICATIONS

European Search Report dated Apr. 24, 2017.
Chinese Office Action; Appl 201580020194.4; dated Jul. 31, 2017.

*Primary Examiner* — Geoffrey Mruk
(74) *Attorney, Agent, or Firm* — Duft Bornsen & Fettig LLP

(57) ABSTRACT

An inkjet head that is able to circulate ink. The inkjet head includes a diaphragm plate, a first restrictor plate, one or more chamber plates, a second restrictor plate, and an orifice plate. The orifice plate forms a plurality of nozzles. The chamber plates form a plurality of chambers corresponding with the nozzles, and also form a return manifold for receiving ink from the chambers when circulating the ink through the inkjet head. The diaphragm plate forms a diaphragm that seals the chambers. The first restrictor plate controls a flow of ink between the chambers and the return manifold to circulate the ink through the inkjet head. The second restrictor plate controls the flow of ink between a supply manifold and the chambers.

20 Claims, 7 Drawing Sheets

Related U.S. Application Data continuation of application No. 14/261,370, filed on Apr. 24, 2014, now Pat. No. 9,272,514.

(56) References Cited

U.S. PATENT DOCUMENTS

| | | | | |
|---|---|---|---|---|
| 2009/0160887 | A1 | 6/2009 | Hamazaki et al. | |
| 2012/0176450 | A1 | 7/2012 | Akahane et al. | |
| 2016/0136962 | A1* | 5/2016 | Nishimura | B41J 2/1433 347/89 |

* cited by examiner

INKJET HEAD THAT CIRCULATES INK

RELATED APPLICATIONS

This non-provisional patent application is a continuation of U.S. patent application Ser. No. 15/007,105 filed on Jan. 26, 2016, which claimed priority to U.S. Pat. No. 9,272,514 filed on Apr. 24, 2014; both of which are incorporated herein by reference.

FIELD OF THE INVENTION

The following disclosure relates to the field of printing, and in particular, to inkjet heads used in printing.

BACKGROUND

Inkjet printing is a type of printing that creates a digital image by propelling droplets of ink onto a medium, such as paper. The core of an inkjet printer includes one or more the print heads (referred to herein as inkjet heads) having a series of nozzles that are used to spray drops of ink. The structure of an inkjet head typically includes a housing, a series of plates, and a piezoelectric actuator. The housing has an opening for the piezoelectric actuator to pass through, and an inlet that connects to an ink supply (e.g., an ink cartridge). The inlet for the ink supply also connects to a groove in the housing that forms an ink supply channel for the inkjet head.

The plates of the inkjet head are attached to the housing and to one another to form a laminated structure. The laminated structure forms a plurality of ink channels that are each capable of dispersing ink. Each ink channel includes a nozzle, a chamber for ink, and a mechanism for ejecting the ink from the chamber and through the nozzle, which is typically a diaphragm. In order to form the ink channels, a common inkjet head includes a diaphragm plate, a restrictor plate, a chamber plate, and an orifice plate. The orifice plate includes a row of small holes that comprise the nozzles for the inkjet head. The chamber plate includes a row of openings that form chambers for the ink. The restrictor plate also includes a row of openings which form restrictors that fluidly connect the chambers to the ink supply and that control the flow of ink into the chambers. The diaphragm plate forms diaphragms over the chambers with a sheet of a semi-flexible material. The diaphragm plate also includes openings that allow ink to be drawn from the ink supply and into the chambers when the diaphragms vibrate.

The piezoelectric actuator includes a plurality of piezoelectric elements that attach to the diaphragm plate. Each piezoelectric element corresponds to one of the chambers formed in the chamber plate. When electrical signals are selectively applied to the piezoelectric elements, the elements expand and contract. This causes the diaphragms to vibrate over the chambers, which changes the volume of the chambers. The change in the volume of the chamber causes ink to be ejected from the chambers through the nozzles on the orifice plate.

One problem with inkjet heads is that the ink can dry in the nozzles or chambers when the head or individual nozzles are not in use. One or more of the ink channels can therefore become clogged within the head.

SUMMARY

Embodiments described herein provide for an inkjet head that circulates ink, or another material, through ink channels in the head. Circulation of ink through the ink channels provides advantages, such as automatically priming the ink channels with little waste, removing air bubbles near the nozzles, preventing heavy pigments from settling, and keeping ink from drying at the nozzles. To allow for circulation of ink, an additional restrictor plate is added to the head structure proximate to the nozzles of the inkjet head. The plates of the inkjet head also form a return manifold, where ink in the chambers of the head may flow through the additional restrictor plate and into the return manifold. With this configuration, ink may flow through the ink channels so that it is less likely to dry within the inkjet head and clog the nozzles.

One embodiment is an inkjet head comprising an orifice plate formed with a plurality of nozzles through which ink droplets are ejected. The inkjet head further includes first restrictor plate, and one or more chamber plates that form a plurality of chambers corresponding with the respective nozzles. The chamber plates also form a return manifold for circulating ink through the inkjet head. The head further includes a second restrictor plate, and a diaphragm plate that has a diaphragm for sealing the chambers. The first restrictor plate controls a flow of ink between the chambers and the return manifold. The second restrictor plate controls the flow of ink between a supply manifold and the chambers.

In another embodiment, the inkjet head further includes a plurality of piezoelectric elements attached to the diaphragm at positions opposite the chambers.

In another embodiment, the inkjet head further includes a housing that includes an opening for the piezoelectric elements to pass through to contact the diaphragm plate, and that includes a first groove on a surface facing the diaphragm plate that encompasses the opening for the piezoelectric elements to form the supply manifold. The housing may also include a second groove on the surface facing the diaphragm plate for the return manifold.

In another embodiment, the housing may include an inlet hole in the first groove that connects the supply manifold to a first reservoir, and an outlet hole in the second groove of the housing that connects the return manifold to a second reservoir.

In another embodiment, the pressure at the supply manifold (P_in) is positive, the pressure at the return manifold (P_out) is negative, and P_in+P_out is negative at the nozzles.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
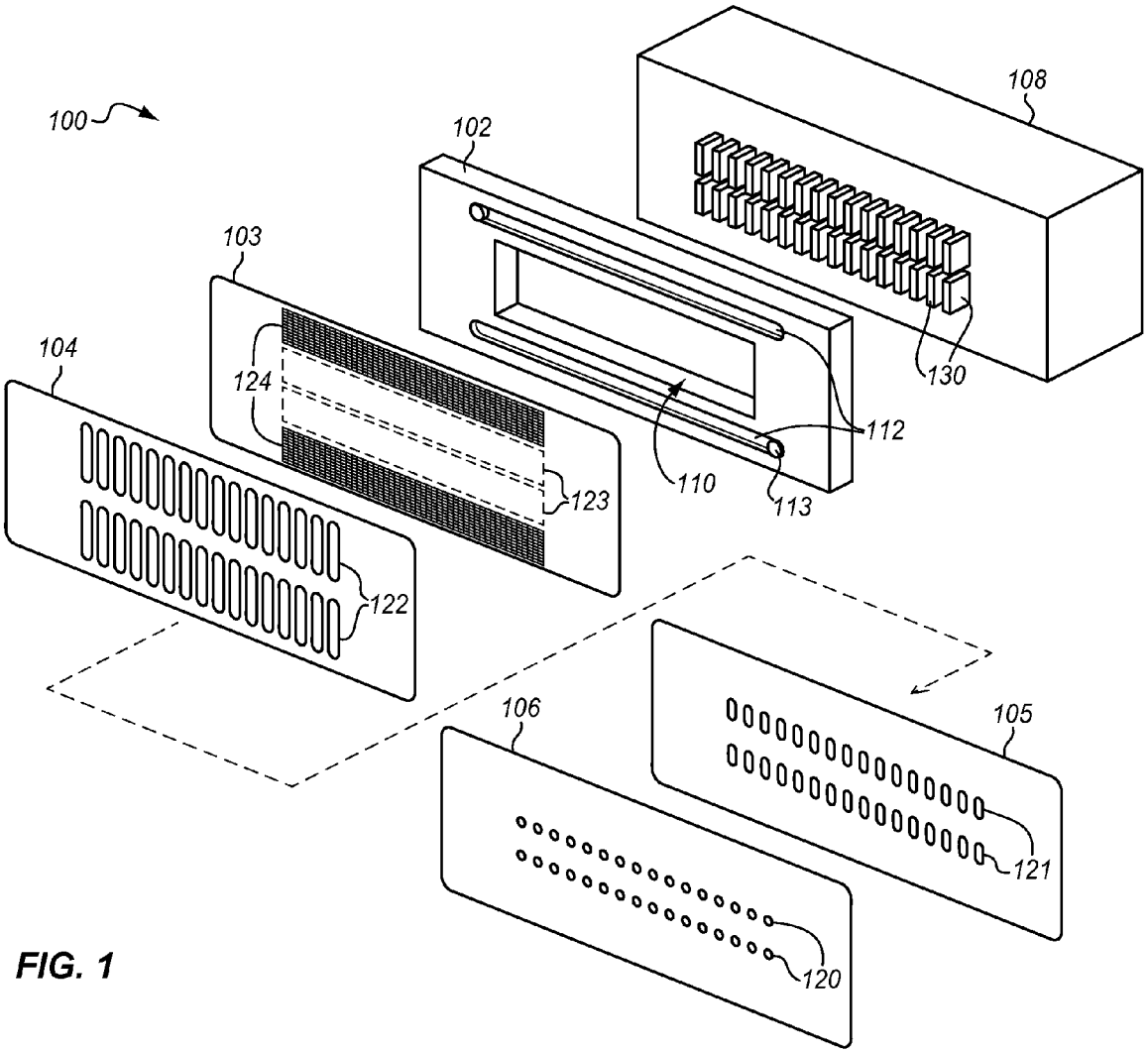
FIG. 1 illustrates an exploded, perspective view of a conventional inkjet head.

FIG. 1 illustrates an exploded, perspective view of a conventional inkjet head 100. Inkjet head 100 forms a plurality of ink channels that are each capable of dispersing ink. Each ink channel includes a nozzle, a chamber for ink, and a mechanism for ejecting the ink from the chamber and through the nozzle, which is typically a diaphragm.

In this example, inkjet head 100 includes a housing 102, a series of plates 103-106, and a piezoelectric actuator 108. Housing 102 is a rigid member to which the plates 103-106 attach to form inkjet head 100. Housing 102 includes an opening 110 for piezoelectric actuator 108 to pass through and interface with a diaphragm plate. Housing 102 further includes one or more grooves 112 on a surface facing plates 103-106 for supplying ink to the ink channels. Groove 112 includes one or more holes 113 that are in fluid communication with an ink reservoir.

The plates 103-106 of inkjet head 100 are fixed or bonded to one another to form a laminated plate structure, and the laminated plate structure is affixed to housing 102. The laminated plate structure includes the following plates: an orifice plate 106, a chamber plate 105, a restrictor plate 104, and a diaphragm plate 103. Orifice plate 106 includes a plurality of nozzles 120 that are formed in one or more rows. Chamber plate 105 is formed with a plurality of chambers 121 that correspond with the nozzles 120 of orifice plate 106. The chambers 121 are each able to hold ink that is to be ejected out its corresponding nozzle. Restrictor plate 104 is formed with a plurality of restrictors 122. The restrictors 122 fluidly connect chambers 121 to the ink supply, and control the flow of ink into chambers 121. Diaphragm plate 103 is formed with diaphragms 123 and filter sections 124. Diaphragms 123 each comprise a sheet of a semi-flexible material that vibrates in response to actuation by piezoelectric actuator 108. Filter sections 124 remove foreign matter from ink entering into the ink channels.

Piezoelectric actuator 108 includes a plurality of piezoelectric elements 130; one for each of the ink channels. The ends of piezoelectric elements 130 contact diaphragms 123 in diaphragm plate 103. An external drive circuit (not shown) is able to selectively apply electrical signals to piezoelectric elements 130 which vibrate the diaphragm 123 for individual ink chambers. The vibration of diaphragms 123 changes the volume of the chambers 121, which in turn changes the pressure in the chambers 121. The change in pressure in a chamber 121 causes ink to be ejected from its corresponding nozzle 120. Inkjet head 100 can therefore print desired patterns by selectively "activating" the ink channels to discharge ink out of their respective nozzles.

When inkjet head 100 is not in use for a period of time, or one or more of the ink channels is not in use during print operations for a period of time, the ink in the nozzles 120 and the chambers 121 can begin to dry. For example, ink that has a heavy pigment, magnetic ink, photopolymer materials used for three-dimensional (3D) printing, and the like can quickly begin to dry or harden in the inkjet head 100 when the ink channels are not used for printing. This can unfortunately clog inkjet head 100, which may require cleaning before the head can be used again for printing. To avoid clogging of an inkjet head, the following embodiments describe an inkjet head that is able to circulate (or recirculate) ink or other printing liquids/fluids within the inkjet head. In order to circulate ink, a return manifold is formed in the inkjet head. The return manifold is fluidly connected to the chambers of the ink channels through an additional restrictor plate proximate to the nozzles. The additional restrictor plate controls a flow of ink from the chambers (near the nozzles) into the return manifold. With this configuration, ink may be circulated within the inkjet head from the supply manifold, through the chambers, and into the return manifold so that the ink is less likely to dry within the inkjet head and clog the nozzles.

Figure 2:
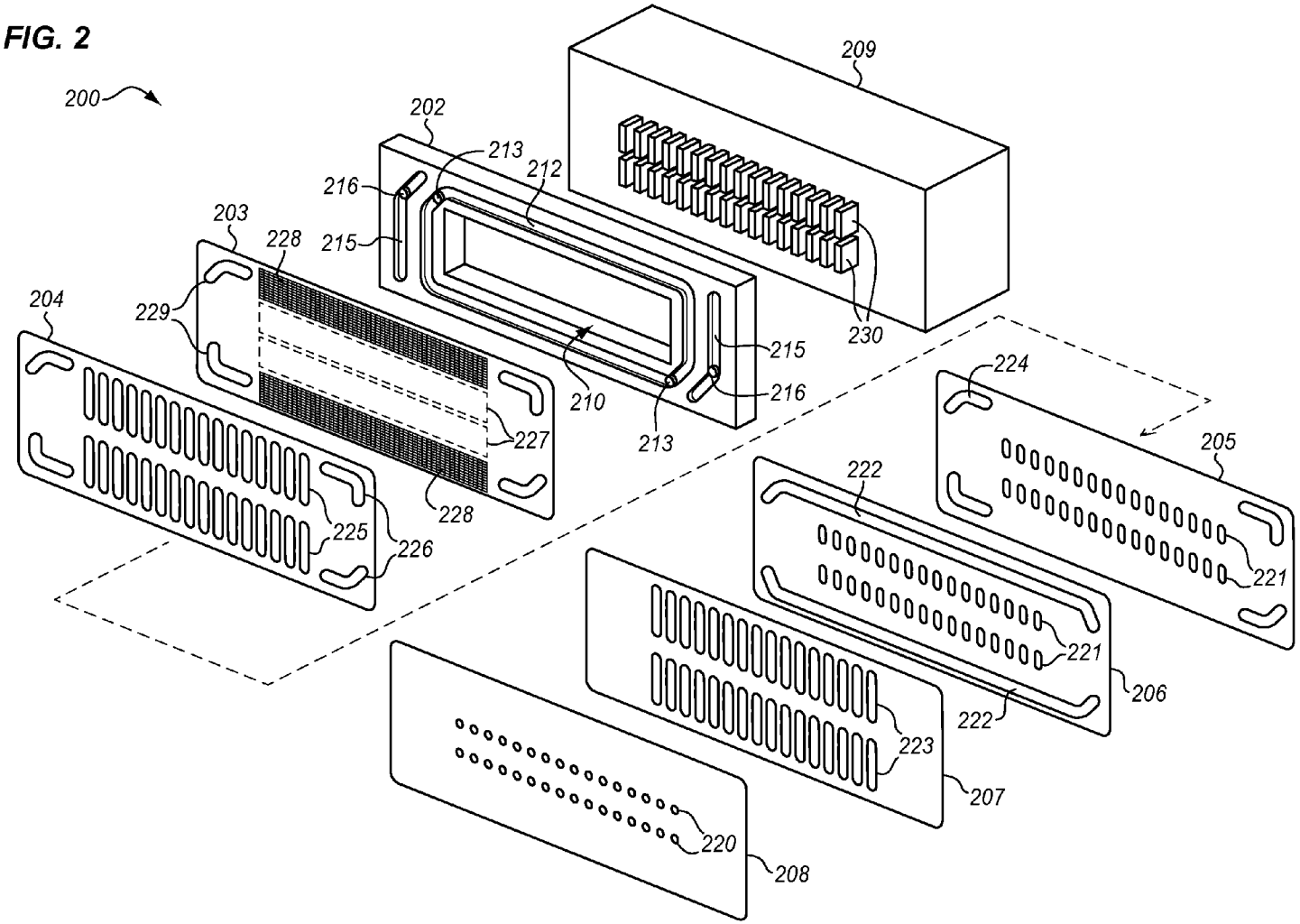
FIG. 2 illustrates an exploded, perspective view of an inkjet head in an exemplary embodiment.

FIG. 2 illustrates an exploded, perspective view of an inkjet head 200 in an exemplary embodiment. The inkjet heads as described herein, such as inkjet head 200, may be used for two-dimensional (2D) printing or three-dimensional (3D) printing. Therefore, inkjet heads may be implemented in an apparatus for printing, such as an inkjet printer. In this embodiment, inkjet head 200 includes a plurality of ink channels that are each capable of dispersing ink. Each channel includes a nozzle, a chamber for ink, and a mechanism for ejecting the ink from the chamber and through the nozzle, which is typically a diaphragm. The term "ink" as defined herein comprises any material, fluid, or liquid that may be applied by an inkjet head to a medium. The term "ink" does not solely refer to liquids that contain pigments or dyes, but may also refer to liquids that contain plastic filaments, photopolymers, etc., which are used for 3D printing.

In this embodiment, inkjet head 200 includes a housing 202, a series of plates 203-208, and a piezoelectric actuator 209. Housing 202 is a rigid member to which the plates 203-208 attach to form inkjet head 200. Housing 202 includes an opening 210 for piezoelectric actuator 209 to pass through and interface with a diaphragm plate, which will be explained in more detail below. Housing 202 further includes a groove 212 on the surface facing plates 203-208 that encompasses or substantially surrounds opening 210. Groove 212 includes one or more holes 213 that are in fluid communication with an ink reservoir, such as a supply reservoir. Therefore, groove 212 may represent a conduit for ink to travel from an ink reservoir to the individual ink channels in order to supply ink to the ink channels. The conduit (which includes groove 212) for supplying ink to the ink channels is referred to herein as a "supply manifold".

Housing 202 further includes one or more grooves 215 on the surface facing plates 203-208 that are separate or isolated from groove 212. Groove 215 includes one or more holes 216 that are in fluid communication with another ink reservoir, such as a return reservoir. Therefore, groove 215 may represent a conduit for ink to travel out of the ink channels in inkjet head 200 (instead of out of the nozzles of the head) in order to circulate ink through inkjet head 200. The conduit (which includes groove 215) for removing ink from the ink channels during circulation is referred to herein as a "return manifold". Although a supply reservoir and a return reservoir are described herein, a single reservoir may be used.

Plates 203-208 of inkjet head 200 are fixed or bonded to one another to form a laminated plate structure, and the laminated plate structure is affixed to housing 202. The plate structure illustrated in FIG. 2 is intended to be an example of a basic structure to show how circulation may be implemented in inkjet head 200. There may be additional plates that are used in the plate structure that are not shown in FIG. 2. Also, FIG. 2 is not necessarily drawn to scale.

In this embodiment, the laminated plate structure includes the following plates: an orifice plate 208, a first restrictor plate 207, chamber plates 205-206, a second restrictor plate 204, and a diaphragm plate 203. Orifice plate 208 includes a plurality of nozzles 220 that are formed in one or more rows. Each nozzle 220 represents an individual ink channel in inkjet head 200 for ejecting ink. Although inkjet head 200 is shown as having two rows of nozzles in this embodiment, inkjet head 200 may have a single row of nozzles or more rows of nozzles in other embodiments.

Chamber plates 205-206 are each formed with a plurality of chambers 221 that correspond with the nozzles 220 of orifice plate 208. Chambers 221 may be referred to as "supply chambers" or "pressure chambers". Each chamber 221 is an opening in chamber plate 205-206, and represents the portion of an ink channel that holds the ink which is ejected out its corresponding nozzle 220.

Chamber plate 206 is also formed with elongated openings 222 that are parallel to the row of chambers 221, which are referred to as "return openings". Return openings 222 are slots that provide a further conduit for the ink to travel out of the ink channels in inkjet head 200 (instead of out of the nozzles of the head) in order to circulate ink through inkjet head 200. Thus, return openings 222 are part of the return manifold for inkjet head 200. Chamber plate 205 is formed with return openings 224 that are part of the return manifold for inkjet head 200. The return openings 224 in chamber plate 205 are positioned off to the side of the rows of chambers 221. When bonded as a laminate, the return openings 224 in chamber plate 205 will partially overlap with the return openings 222 in chamber plate 206. The return openings 224 in chamber plate 205 will also correspond with grooves 215 in housing 202 to form the return manifold.

Restrictor plate 207 is sandwiched between orifice plate 208 and chamber plate 206. Restrictor plate 207 is formed with a plurality of restrictors 223. The restrictors 223 fluidly connect chambers 221 to the return manifold. When ink is circulated through inkjet head 200, restrictors 223 control the flow of ink that circulates out of the chambers 221 and into the return manifold.

Restrictor plate 204 is sandwiched between chamber plate 205 and diaphragm plate 203. Restrictor plate 204 is formed with a plurality of restrictors 225. The restrictors 225 fluidly connect chambers 221 to the supply manifold, and control the flow of ink into chambers 221. Restrictor plate 204 is formed with return openings 226 that are part of the return manifold for inkjet head 200. The return openings 226 in restrictor plate 204 are positioned off to the side of the rows of restrictors 225. When bonded as a laminate, the return openings 226 in restrictor plate 204 will correspond with grooves 215 in housing 202 to form the return manifold.

Diaphragm plate 203 is formed with diaphragms 227 and filter sections 228. Diaphragms 227 each comprise a sheet of a semi-flexible material that extends longitudinally to correspond with the chambers 221, and vibrates in response to actuation by piezoelectric actuator 209. Filter sections 228 extend longitudinally to correspond with the supply manifold, and to remove foreign matter from ink flowing in the ink channels from the supply manifold. Although diaphragm plate 203 is shown as including both diaphragms 227 and filter sections 228 in this embodiment, diaphragms 227 and filter sections 228 may be implemented in separate plates in other embodiments. Diaphragm plate 203 is also formed with return openings 229 that are part of the return manifold for inkjet head 200. The return openings 229 in diaphragm plate 203 are positioned off to the side of the rows of diaphragms 227. When bonded as a laminate, the return openings 229 in diaphragm plate 203 will correspond with grooves 215 in housing 202 to form the return manifold.

Piezoelectric actuator 209 includes a plurality of piezoelectric elements 230; one for each of the ink channels. The ends of piezoelectric elements 230 contact diaphragms 227 in diaphragm plate 203 at positions opposite the chambers 221. An external drive circuit (not shown) is able to selectively apply electrical signals to piezoelectric elements 230 which vibrate the diaphragm 227 for individual ink chambers. The vibration of diaphragms 227 changes the volume of chambers 221, which in turn changes the pressure in chambers 221. The change in pressure in a chamber 221 causes ink to be ejected from its corresponding nozzle 220.

Figure 3:
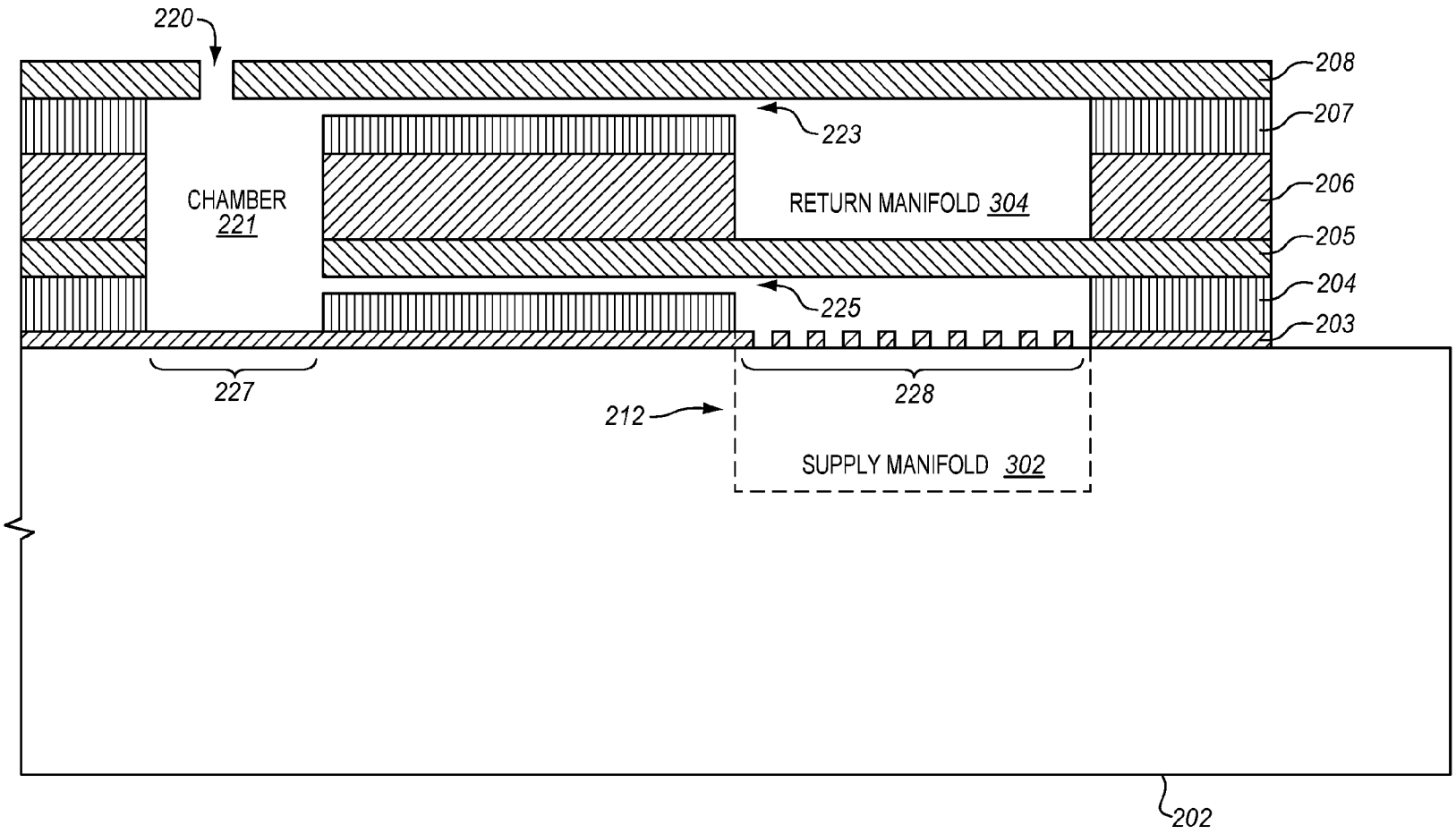
FIG. 3 illustrates a cross-sectional view of an ink channel within the inkjet head of FIG. 2 in an exemplary embodiment.

FIG. 3 is a cross-sectional view of an ink channel in inkjet head 200 in an exemplary embodiment. The view in FIG. 3 is as if a slice where taken through the center of a nozzle 220 in head 200. The slice is then oriented in FIG. 3 with the nozzle 200 facing upward. Again, the plate structure illustrated in FIG. 3 is intended to be an example of a basic structure to show how circulation may be implemented in inkjet head 200. There may be additional plates that are used in the plate structure that are not shown in FIG. 3. Also, FIG. 3 is not necessarily drawn to scale.

Beginning at the bottom of FIG. 3, the diaphragm plate 203 is shown as being connected to housing 202. The filter section 228 of diaphragm plate 203 lines up with the supply manifold 302 formed by groove 212. The diaphragm 227 of diaphragm plate 203 lines up with the chamber 221 of the ink channel. Restrictor plate 204 is sandwiched between diaphragm plate 203 and the chamber plates 205-206. Restrictor plate 204 includes restrictor 225 that controls a flow of ink from the supply manifold 302 to the chamber 221 for the ink channel.

Chamber plates 205-206 form the chamber 221 for the ink channel. Chamber plate 206 also forms the return manifold 304 for the ink to circulate through the ink channel. Restrictor plate 207 is sandwiched between chamber plate 206 and orifice plate 208. Restrictor plate 207 includes restrictor 223 that controls a flow of ink from the chamber 221 to the return manifold 304. The top plate in FIG. 3 is orifice plate 208 that has the nozzle 220 for the ink channel.

Figure 4:
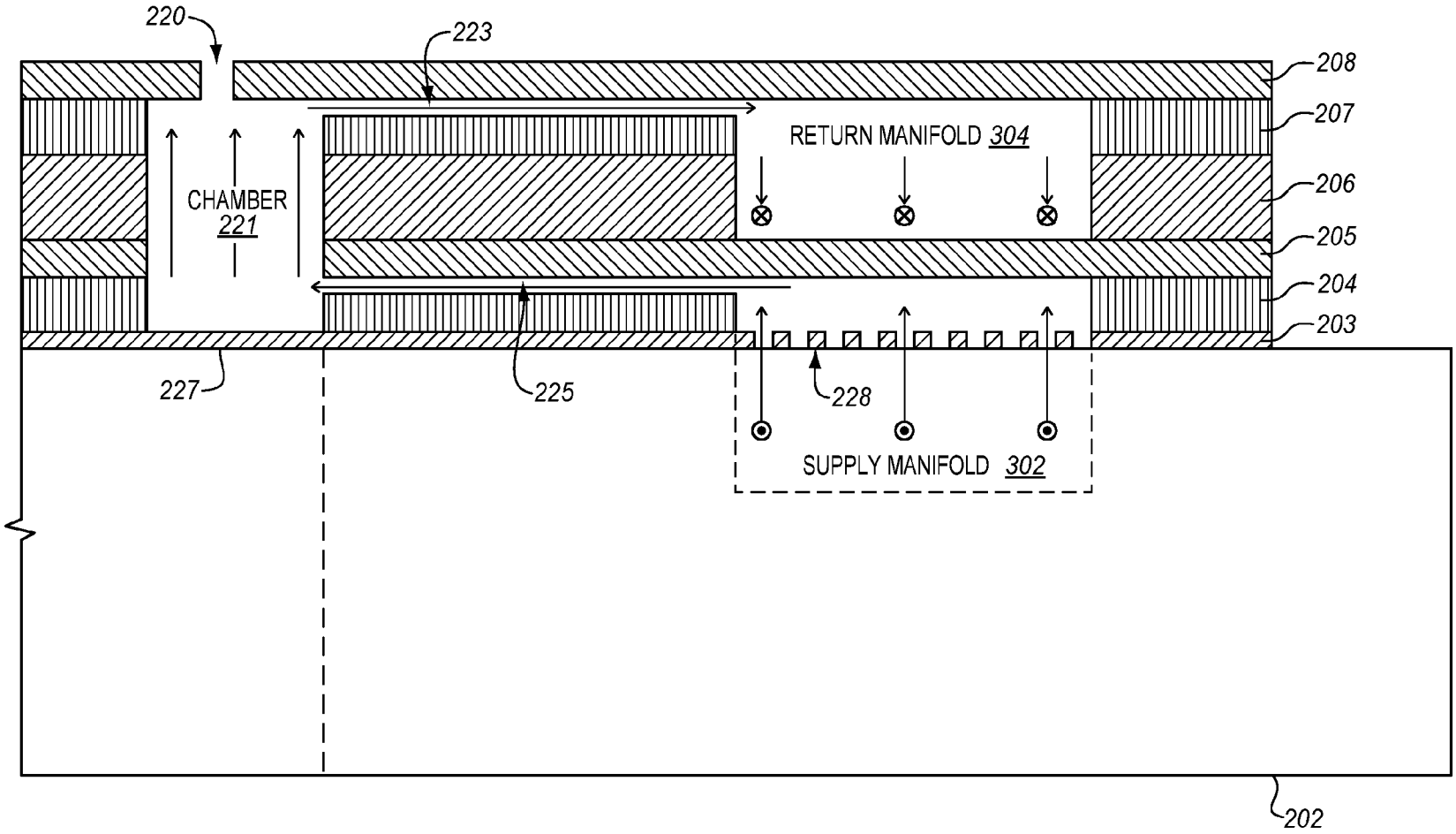
FIG. 4 illustrates a cross-sectional view of ink circulating through the ink channel in an exemplary embodiment.

FIG. 4 is a cross-sectional view of ink circulating through the ink channel in an exemplary embodiment. The ink flow is illustrated by the arrows in FIG. 4. During a circulation, the ink flows into supply manifold 302, as is illustrated by arrow points coming out of the page of FIG. 4. The ink then flows from supply manifold 302, through the filter section 228 of diaphragm plate 203, and through the restrictor 225 in restrictor plate 204 (see also FIGS. 2-3). After passing through the restrictor 225, the ink flows into the chamber 221 of the ink channel formed by chamber plates 205-206. The ink then flows through the restrictor 223 in restrictor plate 207 (instead of exiting out of the nozzle 220 in orifice plate 208), and enters into return manifold 304 (see also FIGS. 2-3). The ink will then flow out of return manifold 304, as is illustrated by arrow tails going into the page of FIG. 4. As is evident from this figure, circulation of ink in inkjet head 200 is possible because return manifold 304 and an additional restrictor 223 has been added to the ink channel to allow ink to flow out of the chamber 221 of an ink channel instead of sitting in the chamber 221 and potentially drying or settling. The flow directions shown in FIG. 4 are exemplary, and the actual flow of ink may depend on the position of the ink channel in the inkjet head 200.

As is evident from FIGS. 3-4, restrictor 225 is formed on one end of chamber 221 toward the diaphragm 227, and restrictor 223 is formed on the other end of chamber 221 toward the nozzle 220. The vertical position of restrictor 225 in the stack generally corresponds with the vertical position of restrictor 223 in the stack, with the chamber plates 205-206 separating the restrictors. Because of the way restrictors 223 and 225 are formed in the laminated structure, the vertical position of return manifold 304 corresponds with the vertical position of the supply manifold 302 in the laminated structure (i.e., return manifold 304 is formed on top of supply manifold 302 with a layer between them). This is advantageous because the inkjet head 200 can be made narrow, but is still able to circulate ink to avoid clogging.

In order to circulate ink as illustrated in FIG. 4, the pressure in the supply manifold 302 and the return manifold 304 may be regulated. Drop-On-Demand (DOD) inkjet heads operate with slight negative pressure at their nozzles. This is to prevent ink from flowing out of the nozzles unintentionally. When inkjet head 200 is circulating ink, pressure at the supply manifold (P_in) and pressure at the return manifold (P_out) may be set as follows:

$P$_in=positive $P$_out=negative $P$_in+$P$_out=slightly negative at the nozzle(s)

$P$_in−$P$_out=depends on the requirements (ink settling, drying prevention, and air removal, while still maintaining jetting stability).

If a dual reservoir design is used, ink may be circulated by controlling the pressures for the reservoirs. The supply reservoir is regulated to have a positive pressure, while the return reservoir is regulated to have a negative pressure. The pressures are regulated in such a manner that the pressure at the nozzles are slightly negative. If a single reservoir design is used, then a pump may be placed in line with an inlet to the inkjet head to pump fluid into the head. Another pump may be placed in line with an outlet from the inkjet head to pump the fluid out of the head. The pumps may be used to regulate the positive pressure (inlets) and negative pressure (outlets) so that the pressure at the nozzles is slightly negative.

Figure 7:
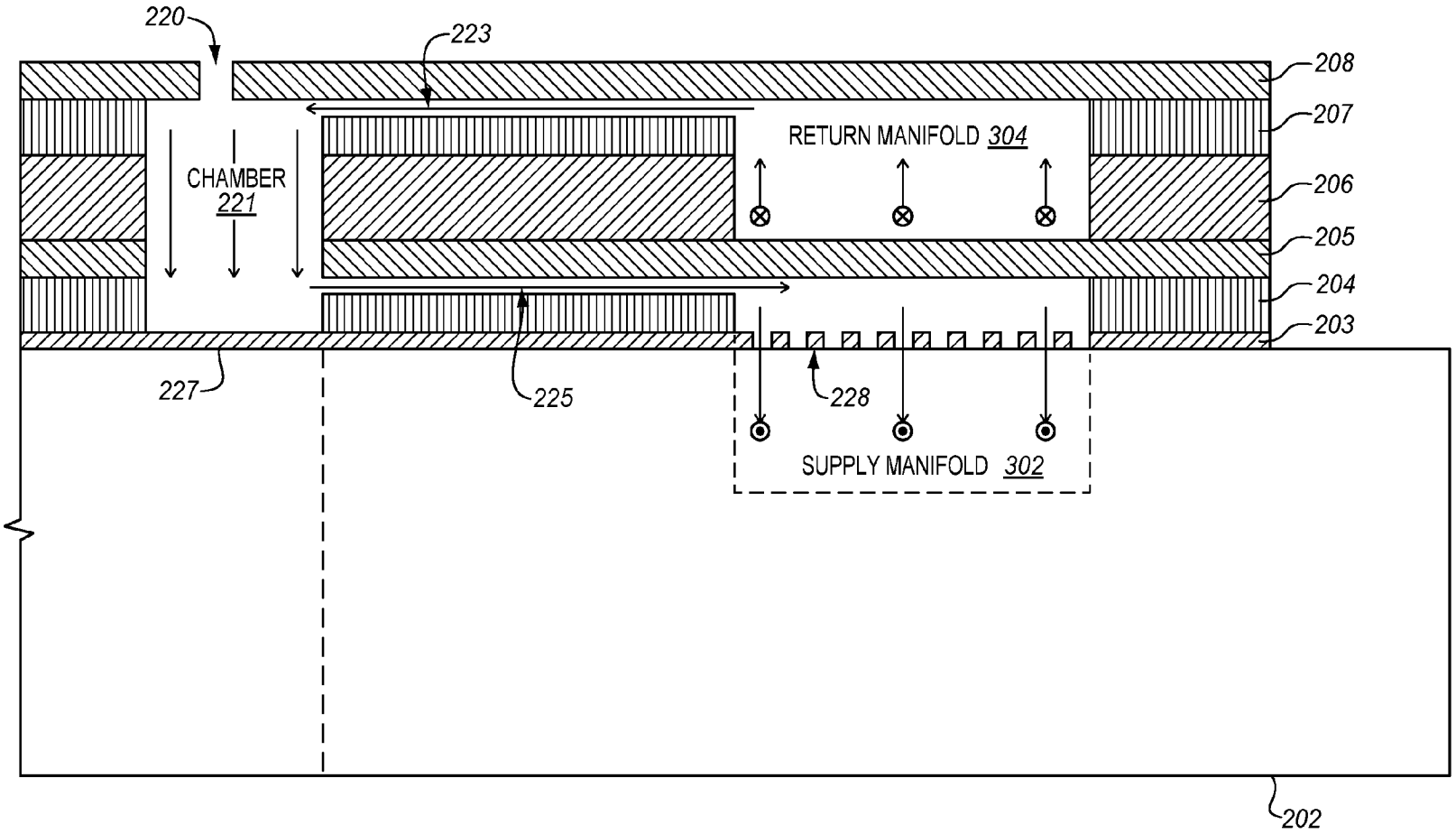
FIG. 7 is a cross-sectional view of ink circulating through the ink channel in a reverse direction in an exemplary embodiment.

The flow direction in inkjet head 200 may also be reversed in other embodiments. Because restrictors 223 and 225 have similar designs, ink may flow in either direction through inkjet head 200. Therefore, even though manifold 302 is referred to as a "supply" manifold and manifold 304 is referred to as a "return" manifold, the flow of ink through inkjet head 200 may be reversed to be the opposite of that shown in FIG. 4. FIG. 7 is a cross-sectional view of ink circulating through the ink channel in a reverse direction in an exemplary embodiment. During a circulation in this embodiment, the ink first flows into return manifold 304, and then through the restrictor 223 into chamber 221 of the ink channel. The ink then flows through the restrictor 225 in restrictor plate 204, and enters into supply manifold 302. The ink will then flow out of the supply manifold. If the flow of ink is reversed in this manner, another filter plate may be used to filter the ink that enters through return manifold 304.

Example

Figure 5:
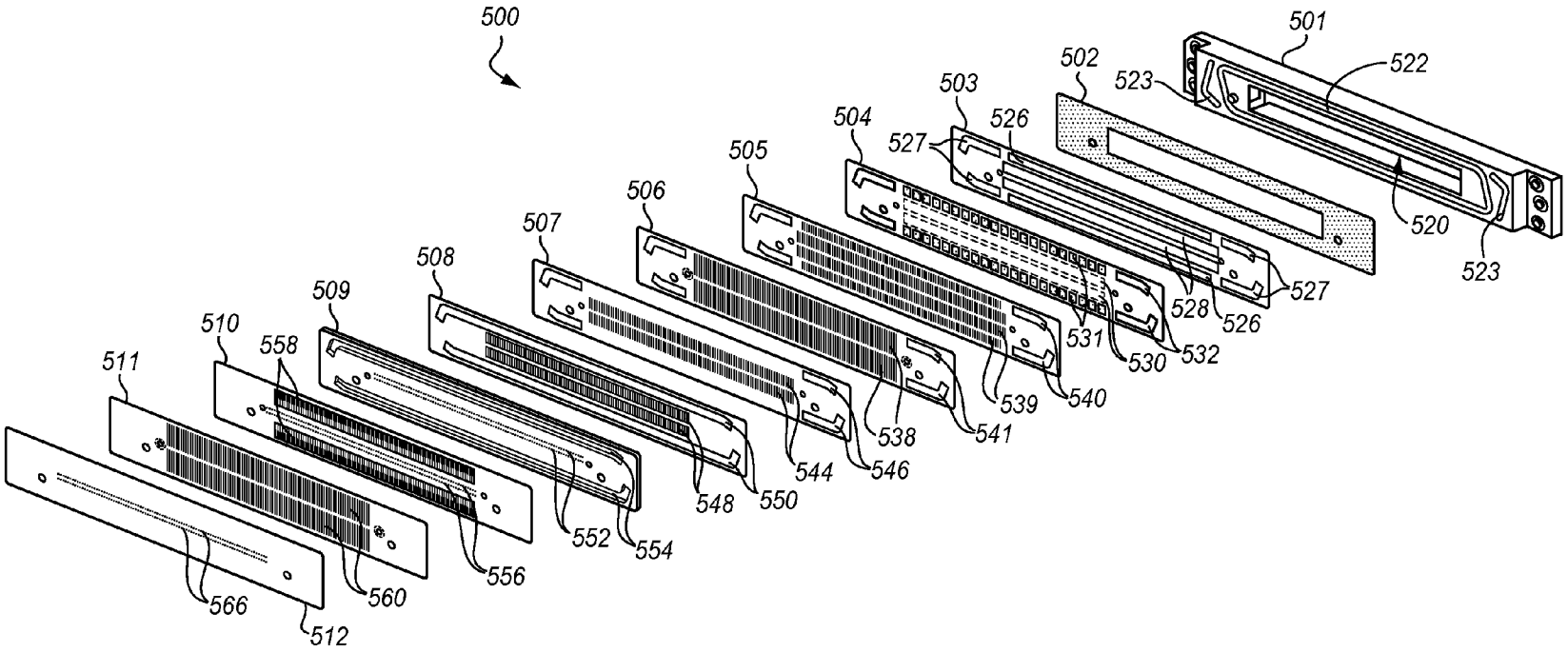
FIG. 5 illustrates an exploded, perspective view of an inkjet head in an exemplary embodiment.

FIG. 5 illustrates an exploded, perspective view of an inkjet head 500 in an exemplary embodiment. The structure illustrated in FIG. 5 is just one particular example, and the embodiments described herein are not limited to the structure shown in the figure. In this example, inkjet head 500 includes a housing 501 and a series of plates 502-512 that are fixed or bonded to one another to form a laminated plate structure. Housing 501 includes an opening 520 for a piezoelectric actuator (not shown). Housing 501 further includes a supply groove 522 that encompasses or substantially surrounds opening 520. Supply groove 522 forms the supply manifold for inkjet head 500. Housing 501 also includes return grooves 523 that form the return manifold for inkjet head 500.

Plate 502 is a filter plate that is porous (i.e., has many small holes that allow liquid to pass through), and removes foreign matter from the ink flowing in from the supply manifold. Filter plate 502 also includes an opening proximate to its center for the piezoelectric actuator to pass through. Plate 503 is a manifold plate that includes elongated supply openings 526 near its top and bottom for the supply manifold, and return openings 527 towards its ends (left and right in FIG. 5) for the return manifold. Manifold plate 503 further includes elongated openings 528 toward its center for piezoelectric elements of the actuator to pass through.

Plate 504 is a diaphragm plate. Diaphragm plate 504 is formed with diaphragms 530 and filter sections 531. Diaphragms 530 each comprise a sheet of a semi-flexible material that vibrates in response to actuation by a piezoelectric actuator. Filter sections 531 remove foreign matter from ink flowing from the supply manifold. Diaphragm plate 504 also includes return openings 532 towards its ends (left and right in FIG. 5) for the return manifold.

Plate 505 is a support plate, and plate 506 is a restrictor plate. Support plate 505 is used in conjunction with restrictor plate 506 to control the flow of ink through restrictors. Restrictor plate 506 includes parallel rows of restrictors 538. A restrictor 538 is formed as an opening or aperture (which is vertical in FIG. 5), and one restrictor 538 from restrictor plate 506 corresponds with one ink channel for inkjet head 500. Support plate 505 has openings 539 that correspond with the restrictors 538 in restrictor plate 506 to control the flow of ink through restrictors 538. Support plate 505 and restrictor plate 506 each include return openings 540-541, respectively, towards their ends (left and right in FIG. 5) that form the return manifold.

Plate 507 is a chamber plate. Chamber plate 507 includes two parallel rows of chambers 544. A chamber 544 is formed as an opening or aperture (which is vertical in FIG. 5), and one chamber 544 in chamber plate 507 corresponds with one ink channel for inkjet head 500. A chamber 544 represents the portion of an ink channel that holds the ink, and the pressure in the chamber 544 is changed to eject the ink out of its corresponding nozzle. Chamber plate 507 also includes return opening 546 towards its ends (left and right in FIG. 5) that form the return manifold.

Plate 508 is also a chamber plate. Chamber plate 508 has a similar configuration as chamber plate 507 with parallel rows of chambers 548. The return opening is different in chamber plate 508, which has an elongated opening 550 near its top and bottom for the return manifold instead of just toward its ends as with chamber plate 507.

Plate 509 is also a chamber plate. Chamber plate 509 is configured with parallel row of chambers 552. The size of the openings for the chambers 552 in this plate is illustrated as smaller than the openings for the chambers 544, 548 in plates 507-508. Chamber plate 509 also has an elongated return opening 554 near its top and bottom for the return manifold.

Plate 510 is another chamber plate. Chamber plate 510 includes parallel rows of chambers 556 like the other chamber plates. Chamber plate 510 also includes rows of manifold patterns 558. The portion of manifold patterns 558 nearest the chambers 556 are partially etched to assist in controlling the flow of ink from the chambers into the return manifold (in conjunction with restrictors in another restrictor plate 511). The portion of manifold pattern 558 towards the top and bottom of chamber plate 510 are openings that form the return manifold. Although four chamber plates are illustrated in FIG. 5, more or less chamber plates may be used to form the ink chambers as desired.

Restrictor plate 511 includes parallel rows of restrictors 560. A restrictor 560 is formed as an opening or aperture (which is vertical in FIG. 5), and one restrictor 560 from restrictor plate 511 corresponds with one ink channel for inkjet head 500. The partially-etched sections of the manifold pattern 558 in chamber plate 510 correspond with the restrictors 560 in restrictor plate 511 to control the flow of ink through restrictors 560 and into the return manifold.

Plate 512 is an orifice plate. Orifice plate 512 includes parallel rows of nozzles 566. A nozzle is a small aperture in orifice plate 512 from which ink may be ejected. One nozzle 566 corresponds with one ink channel for inkjet head 500.

Figure 6:
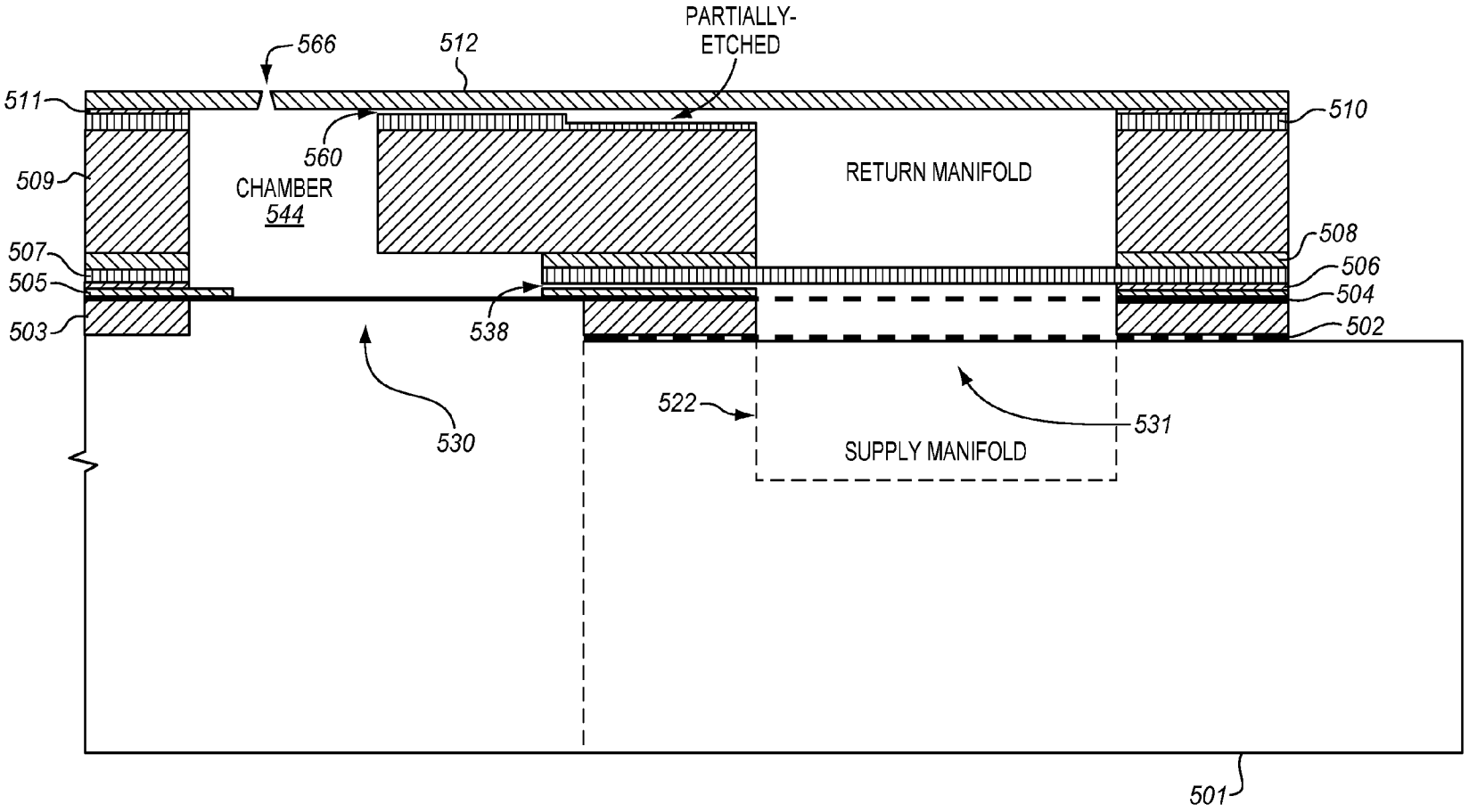
FIG. 6 is a cross-sectional view of an ink channel in the inkjet head of FIG. 5 in an exemplary embodiment.

FIG. 6 is a cross-sectional view of an ink channel in inkjet head 500 in an exemplary embodiment. The view in FIG. 6 is as if a slice were taken through the center of a nozzle 566 in head 500. The slice is then oriented in FIG. 6 with the nozzle 566 facing upward. Again, the plate structure illustrated in FIG. 6 is intended to be an example, as more or less plates may be used in other embodiments. Also, FIG. 6 is not necessarily drawn to scale.

Beginning at the bottom of FIG. 6, filter plate 502 is sandwiched between the housing 501 and manifold plate 503. Diaphragm plate 504 is shown as being connected to manifold plate 503. The filter section 531 of diaphragm plate 504 lines up with the supply manifold formed by groove 522 in housing 501 (see FIG. 5). The diaphragm 530 of diaphragm plate 504 lines up with the chamber 544 of the ink channel.

Next, support plate 505 is bonded to diaphragm plate 504, and restrictor plate 506 is bonded to support plate 505. Restrictor plate 506 includes a restrictor 538, that when used in conjunction with support plate 505, controls a flow of ink from the supply manifold to the chamber 544 for the ink channel. Following restrictor plate 506 are the chamber plates 507-510. Chamber plates 507-510 form the chamber 544 for the ink channel. Chamber plates 508-510 also form the return manifold for the ink to circulate through the ink channel.

Restrictor plate 511 is sandwiched between chamber plate 510 and orifice plate 512. Restrictor plate 511 includes a restrictor 560 that controls a flow of ink from the chamber 544 to the return manifold. As described in FIG. 5, chamber plate 510 has manifold pattern 558 that is partially-etched as indicated in FIG. 6 to work in conjunction with the restrictor 560 in restrictor plate 517. The manifold pattern 558 in chamber plate 510 also has an opening that forms the return manifold. The top plate in FIG. 6 is orifice plate 512 that has the nozzle 566 for the ink channel.

To circulate ink through the ink channel shown in FIG. 6, the pressure at the supply manifold (P_in) is adjusted to a positive pressure, and the pressure for the return manifold (P_out) is adjusted to a negative pressure so that the overall pressure of the ink channel in slightly negative (P_in+P_out=slightly negative at nozzle 566). This will cause ink to circulate through the ink channel without being ejected from nozzle 566. The ink flows from the supply manifold, and through the restrictor 538 in restrictor plate 506 into chamber 544. The ink then flows through the restrictor 560 in restrictor plate 511 (instead of exiting out of the nozzle 566), and enters into the return manifold. The ink will then flow out of the return manifold, and into a return reservoir. This circulation of the ink prevents the ink from sitting in chamber 544 and potentially drying or settling.

In another embodiment, the flow of ink through inkjet head 500 may be reversed. During a circulation in this embodiment, the ink first flows into the return manifold. The ink then flows from the return manifold through the restrictor 560 closest to the nozzle 566 and into chamber 544 of the ink channel. The ink then flows through the other restrictor 538, and enters into the supply manifold. The ink will then flow out of the supply manifold.

Although specific embodiments were described herein, the scope of the invention is not limited to those specific embodiments. The scope of the invention is defined by the following claims and any equivalents thereof.

We claim:

1. An inkjet head comprising:

a series of plates affixed to one another to form a plate structure, wherein the series of plates includes:

a diaphragm plate;

a first restrictor plate that includes a plurality of first restrictors;

a plurality of chamber plates;

a second restrictor plate that includes a plurality of second restrictors; and an orifice plate that includes a plurality of nozzles;

wherein each of the chamber plates includes a row of openings with the openings of each of the chamber plates vertically aligned with one another in the plate structure to form a plurality of chambers that are each able to hold a print fluid to be ejected out its corresponding nozzle.

2. The inkjet head of claim 1 wherein:

the first restrictors control a flow of the print fluid into the chambers.

3. The inkjet head of claim 2 wherein:

the second restrictors control the flow of the print fluid out of the chambers.

4. The inkjet head of claim 3 wherein:

the first restrictors are at one end of the chambers; and the second restrictors are at another opposing end of the chambers toward the nozzles.

5. The inkjet head of claim 4 wherein:

a vertical position of the first restrictors in the plate structure corresponds with a vertical position of the second restrictors in the plate structure with the chamber plates separating the first restrictors and the second restrictors.

6. The inkjet head of claim 1 further comprising:

piezoelectric elements that contact the diaphragm plate.

7. The inkjet head of claim 1 wherein:

the first restrictors and the second restrictors have the same design.

8. The inkjet head of claim 1 wherein the print fluid comprises ink.

9. An inkjet head comprising:

a stack of plates that form a plurality of ink channels each capable of dispersing a print fluid, wherein each ink channel includes:

a first restrictor;

a chamber;

a second restrictor; and a nozzle;

wherein the first restrictor controls a flow of the print fluid into the chamber;

wherein the second restrictor controls the flow of the print fluid out of the chamber;

wherein chambers of the ink channels are formed by a plurality of plates stacked onto one another;

wherein each of the plates includes a row of openings with the openings of each of the plates vertically aligned with one another in the stack to form the chambers.

10. The inkjet head of claim 9 wherein:

the first restrictor is at one end of the chamber; and the second restrictor is at another opposing end of the chamber toward the nozzle.

11. The inkjet head of claim 10 wherein:

a vertical position of the first restrictor in the stack corresponds with a vertical position of the second restrictor in the stack.

12. The inkjet head of claim 9 wherein each ink channel further includes:

a mechanism for ejecting the print fluid from the chamber and through the nozzle.

13. The inkjet head of claim 12 wherein:

the mechanism comprises a diaphragm.

14. The inkjet head of claim 13 further comprising:

a piezoelectric element that contacts the diaphragm for each ink channel.

15. The inkjet head of claim 9 wherein:

the first restrictor and the second restrictor have the same design.

16. An apparatus for printing, comprising:

an inkjet head that includes a series of plates affixed to one another to form a plate structure, wherein the series of plates includes:

a diaphragm plate;

a first restrictor plate that includes a plurality of first restrictors;

a plurality of chamber plates;

a second restrictor plate that includes a plurality of second restrictors; and an orifice plate that includes a plurality of nozzles;

wherein each of the chamber plates includes a row of openings with the openings of each of the chamber plates vertically aligned with one another in the plate structure to form a plurality of chambers that are each able to hold a print fluid to be ejected out its corresponding nozzle.

17. The apparatus of claim 16 wherein:

the first restrictors control a flow of the print fluid into the chambers; and the second restrictors control the flow of the print fluid out of the chambers.

18. The apparatus of claim 17 wherein:

the first restrictors are at one end of the chambers; and the second restrictors are at another opposing end of the chambers toward the nozzles.

19. The apparatus of claim 18 wherein:

a vertical position of the first restrictors in the plate structure corresponds with a vertical position of the second restrictors in the plate structure with the chamber plates separating the first restrictors and the second restrictors.

20. The apparatus of claim 16 wherein:

the first restrictors and the second restrictors have the same design.

* * * * *